US008740756B2

(12) United States Patent
Shabodyash et al.

(10) Patent No.: US 8,740,756 B2
(45) **Date of Patent: *Jun. 3, 2014**

(54) EXERCISE APPARATUS FOR MOBILITY RECOVERY AND SLIMMING

(71) Applicants: Dmitry Shabodyash, Kiryat Gat (IL); Evgeni Gofman, Beer Sheva (IL)

(72) Inventors: Dmitry Shabodyash, Kiryat Gat (IL); Evgeni Gofman, Beer Sheva (IL)

(73) Assignee: Painless Stretch, Beer Sheva (IL)

( * ) Notice: Subject to any disclaimer, the term of this patent is extended or adjusted under 35 U.S.C. 154(b) by 0 days.

This patent is subject to a terminal disclaimer.

(21) Appl. No.: 13/733,176

(22) Filed: Jan. 3, 2013

(65) Prior Publication Data

US 2013/0157811 A1 Jun. 20, 2013

Related U.S. Application Data

(63) Continuation-in-part of application No. 12/997,921, filed as application No. PCT/IL2009/000636 on Jun. 25, 2009, now Pat. No. 8,608,624.

(30) Foreign Application Priority Data

Jun. 26, 2008 (IL) ..... 192476

(51) Int. Cl.
*A63B 22/00* (2006.01)
*A63B 21/00* (2006.01)

(52) U.S. Cl.
USPC ..... 482/54; 482/51

(58) Field of Classification Search
USPC ..... 482/51, 54; 198/388
See application file for complete search history.

(56) References Cited

U.S. PATENT DOCUMENTS

| | | | | |
|---|---|---|---|---|
| 3,582,069 | A * | 6/1971 | Flick et al. | 482/70 |
| 3,637,206 | A * | 1/1972 | Chickering, III | 482/54 |
| 3,641,601 | A | 2/1972 | Sieg | |
| 3,689,066 | A * | 9/1972 | Hagen | 482/54 |

(Continued)

FOREIGN PATENT DOCUMENTS

| | | |
|---|---|---|
| CN | 2889376 | 4/2007 |
| GB | 1326263 | 8/1973 |

(Continued)

OTHER PUBLICATIONS

International Preliminary Report on Patentability for PCT/IL2009/000636; 6 pages, mailed Jan. 5, 2011.

(Continued)

*Primary Examiner* — Stephen Crow
(74) *Attorney, Agent, or Firm* — Roach Brown McCarthy & Gruber, P.C.; Kevin D. McCarthy

(57) ABSTRACT

An exercising apparatus and method. The apparatus has an endless sport mat with an outer layer made of elastic material and an inner layer made of a flexible abrasion resisting material, horizontally spaced rollers about which the endless mat is looped, including front and rear driving rollers, and at least three supporting rollers for supporting a selected middle body area of a user, and a rigid frame for housing the rollers. During three stages of advancement of the selected middle body area, (1) a portion of the endless mat is depressed between first and second rollers, (2) the depressed mat portion rotates the first roller and the endless mat is manually driven, and (3) the selected middle body area is massaged by the second roller while performing a propelling movement.

20 Claims, 12 Drawing Sheets

(56) References Cited

U.S. PATENT DOCUMENTS

| | | | | | |
|---|---|---|---|---|---|
| 4,204,673 | A | * | 5/1980 | Speer, Sr. | 482/5 |
| 4,369,081 | A | | 1/1983 | Curry | |
| 4,509,510 | A | | 4/1985 | Hook | |
| 4,625,962 | A | | 12/1986 | Street | |
| 4,892,090 | A | * | 1/1990 | Kaeser | 601/99 |
| 5,018,722 | A | * | 5/1991 | Whitmore | 482/54 |
| 5,081,991 | A | | 1/1992 | Chance | |
| 5,224,909 | A | * | 7/1993 | Hamilton | 482/70 |
| 5,254,064 | A | | 10/1993 | Rock | |
| 5,372,561 | A | | 12/1994 | Lynch | |
| 5,411,279 | A | | 5/1995 | Magid | |
| 5,538,489 | A | | 7/1996 | Magid | |
| 5,607,376 | A | | 3/1997 | Magid | |
| 5,662,560 | A | | 9/1997 | Svendsen | |
| 5,679,101 | A | | 10/1997 | Magid | |
| 5,711,745 | A | * | 1/1998 | Yang | 482/54 |
| 5,951,441 | A | | 9/1999 | Dalebout et al. | |
| 5,951,449 | A | | 9/1999 | Oppriecht | |
| 6,042,514 | A | | 3/2000 | Abelbeck | |
| 6,053,848 | A | * | 4/2000 | Eschenbach | 482/54 |
| 6,152,854 | A | | 11/2000 | Carmein | |
| 6,217,487 | B1 | * | 4/2001 | Reinert | 482/54 |
| 6,264,584 | B1 | | 7/2001 | Bass | |
| 6,348,024 | B1 | | 2/2002 | Hwang | |
| 6,450,923 | B1 | | 9/2002 | Vatti | |
| 6,520,891 | B1 | | 2/2003 | Stephens | |
| 6,609,478 | B2 | | 8/2003 | Del Valle | |
| 6,661,136 | B1 | | 12/2003 | Lee | |
| 6,786,852 | B2 | | 9/2004 | Watterson | |
| 7,022,051 | B2 | | 4/2006 | Ota | |
| 7,510,511 | B2 | | 3/2009 | von Detten | |
| 7,549,938 | B2 | | 6/2009 | Leighton | |
| 7,575,537 | B2 | | 8/2009 | Ellis | |
| 7,621,850 | B2 | | 11/2009 | Piaget | |
| 7,682,291 | B2 | | 3/2010 | Gill | |
| 7,717,830 | B1 | | 5/2010 | Charniga | |
| 7,780,573 | B1 | | 8/2010 | Carmein | |
| 8,608,624 | B2 | * | 12/2013 | Shabodyash et al. | 482/54 |
| 2004/0192514 | A1 | * | 9/2004 | Piaget et al. | 482/54 |

FOREIGN PATENT DOCUMENTS

| | | |
|---|---|---|
| GB | 2335857 | 6/1999 |
| WO | 83/02237 | 7/1983 |
| WO | 03/013664 | 2/2003 |
| WO | 20081040985 | 4/2008 |

OTHER PUBLICATIONS

International Search Report for PCT/IL2009/000636; 6 pages, mailed Jul. 7, 2010.

* cited by examiner before exercising before after exercising after

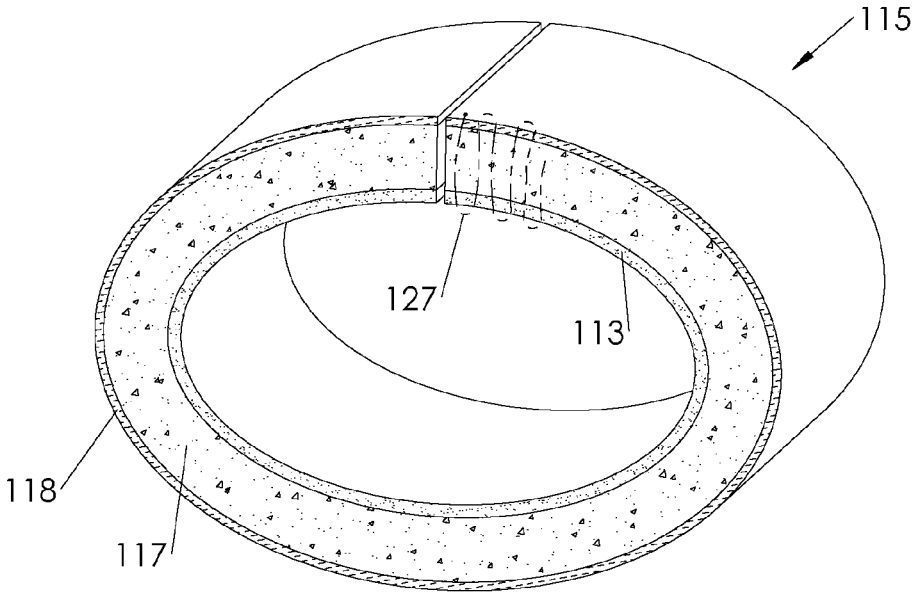
Fig. 12C
Fig. 12C
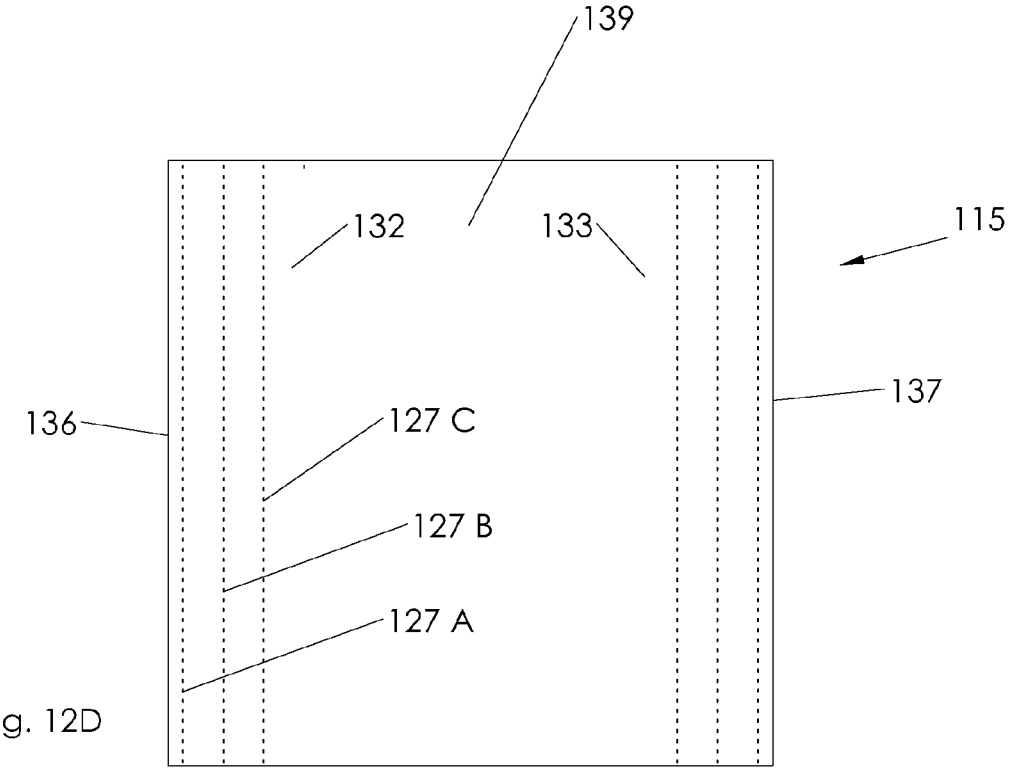
Fig. 12D
Fig. 12D

EXERCISE APPARATUS FOR MOBILITY RECOVERY AND SLIMMING

The present application is a continuation-in-part of U.S. patent application Ser. No. 12/997,921, which is a national phase application of WO 2009/156998 filed on Jun. 25, 2009, which claims priority from Israeli Patent Application No. 192476 filed on Jun. 26, 2008.

FIELD OF THE INVENTION

The present invention relates to the field of therapeutic exercise apparatus. More specifically, it relates to an exercise apparatus for use during crawling movements of the body and designed to recover a skeletal range of motion and abdominal and back muscle tone balance, as well for muscle strengthening.

BACKGROUND OF THE INVENTION

Indoor exercising has become a common practice in modern society, providing shelter, lighting and often accessibility to the people who come to train. It also necessitates a variety of indoor exercise machines with which to train.

There are three main groups of target training, namely: cardio-vascular, muscle development, and muscle sculpting and toning. These entail a variety of apparatuses and methods of training, targeted at achieving these objectives.

One of the most common type of apparatus and method for cardio-vascular training, as well as muscle sculpting and toning, is the indoor walking/running apparatus. This type of apparatus is generally referred to as a "treadmill" apparatus, which is an exercise machine that facilitates indoor walking or running by providing a closed-loop belt, thereby simulating walking/running paths outdoors. Technically, a series of rollers enveloped by a closed-loop belt comprises the exercise area. The rollers translate the linear walking/running motion to rotation of the close-looped belt upon the roller series. The close-looped belt will be referred to herein as an endless tread belt. Thus, the motion is localized to the apparatus area. However, most of the existing types of treadmills restrict the person to upright position activities.

A more distinct group of remedial treadmill-like apparatus is often referred to as "crawlers" or "creepers". This type of apparatus is characterized predominantly by preset, purpose built sets of limb supports, which are designed to accommodate specific, predetermined, sets of orchestrated movements. By creating mechanical interconnection setup options between the designated limb rests, the executable sets of exercises are limited to specially targeted muscle groups.

U.S. Pat. No. 6,217,487 discloses an apparatus and method for quadrupedal exercise, i.e. exercise by walking or running on all fours in a manner similar to four-footed animals. However, this apparatus is restricted both by the limited placement of the limbs, and by the general exercise position.

U.S. Pat. No. 5,224,909 discloses a dual-plane level mid-body exercise crawler apparatus, that has a set level for the leg rests and a slightly elevated level for the hand rests, both set on a rigid frame This configuration enables a preset series of motions such as side to side and/or cross crawling motion, restricted by a gear train assembly between the motion mechanisms of its separate limb rests. However, the predetermined control over the relative movement of the different limbs, limits the exercise scope to a preset number of motions.

U.S. Pat. No. 3,582,069 discloses an improved linkage or coupling arrangement for an exercise apparatus of the creeping and crawling type having pairs of pads mounted for to-and-fro parallel movement in each of pairs of adjacent channels, wherein the diametrically opposite pads simultaneously move in the same direction and pairs of pads move toward and away from each other, characterized by a single cable strand reeved about two pulleys or drums or two separate strands rove about two spaced pairs of pulleys and interconnecting all of the four pads for such movement or rigid linkage means for interconnecting the pads. However, in such apparatus the predetermined control over the relative movement of the different limbs limits the exercise scope to a preset number of those creeping/crawling motions. This apparatus has limited exercise applications by design. It targets specific movement regimes and hence specific muscle groups.

In the prior art, a crawler apparatus targets cooperative activity for skeletal mobility recovery and four limb coordination. This is achieved by using synchronized motion of the hands and legs. The limbs are positioned on designated limb rests that are interconnected by a set of pulleys, which enable side to aside and/or cross, crawling motion.

Such a crawling device targets skeletal mobility and coordination by using synchronized motion of the hands and legs when positioned on specifically designated rests. The rests are interconnected so as to enable a restricted set of specific hand and feet creeping/crawling motions.

It is therefore an object of the present invention to provide an endless tread apparatus that is not restricted to designated limb rests and/or specific sets of exercises and muscle groups.

It is an additional object of the present invention to provide a crawling apparatus, which targets recuperation of skeletal mobility, as well as promoting mid-sectional muscle strengthening and toning.

It is yet another object of the present invention to provide an apparatus for saving room space.

It is a further object of the present invention to provide an apparatus for recovery of skeletal function after trauma.

Further purposes and advantages of this invention will appear as the description proceeds.

SUMMARY OF THE INVENTION

This invention is a manually driven exercising apparatus for allowing mobility recovery and slimming activities during crawling movements of the body, comprising: (a) an endless sport mat on top of which said activities are performable, said mat comprising an outer layer made of a soft and elastic material, and an inner layer contiguous with said outer layer and made of a flexible abrasion resisting material; (b) a plurality of horizontally spaced rollers about which said inner layer of said endless mat is looped, including front and rear driving rollers, and at least three supporting rollers for supporting a selected middle body area of a user in direct contact with said endless mat during performance of crawling movements, said at least three supporting rollers being interposed between said front and rear driving rollers in such a way that adjacent supporting rollers are not in abutting relation with each other, the axis of each of said at least three supporting rollers being essentially horizontally disposed and coplanar; and (c) a rigid frame, for housing, and to which are rotatably mounted, said plurality of rollers.

Said mat outer and inner layers have a sufficient combined degree of flexibility in the vertical direction so that one or more of said at least three supporting rollers is felt by said selected middle body area of the user during performance of said crawling movements.

Each of said supporting rollers is sufficiently spaced from an adjacent supporting roller such that said endless mat is depressible under the weight of the user during said crawling movements thereon between said front and rear driving rollers, causing said plurality of supporting rollers to be rotated and said endless mat to be manually driven, whereby said exercising apparatus massages said selected body area of the user by means of said plurality of supporting rollers in response to a magnitude and direction of forces applied to said plurality of supporting rollers during performance of said crawling movements.

In one aspect, the axis of each of the supporting rollers is spaced from the axis of an adjacent supporting roller or of a driving roller by a distance ranging from 2 to 4 times the diameter of a supporting roller.

In one aspect, the outer layer is compressible up to one-fifth of its original thickness in response to a crawling movement. The original thickness of the outer layer ranges from 5 to 30 mm.

In one aspect, the endless mat is covered with a protective layer. Material of the protective layer is selected from the group consisting of latex, a foil, and sweat resistant material In one aspect, two ends of the protective layer are connected together to form an endless protective strip, said endless protective strip being positioned outwardly from, and stitched to, an endless combined strip made of the inner and outer layers which are adhesively connected to each other. The endless protective strip and the endless combined strip are stitched together by two longitudinally extending stitching formations located proximate to two lateral ends, respectively, of the endless mat, defining therebetween a central unstitched region along which the crawling motions are performable, in said two formation the stitching being introduced throughout the thickness of the endless mat to prevent relative lateral motion between adjacent layers of the endless mat.

In one aspect, the apparatus further comprises one or more stands connected to said frame for stabilizing said apparatus on top of a suitable surface. One or more handles may be attached to the one or more stands for aiding the user to perform some of the activities on the endless mat.

In one aspect, the frame is vertically displaceable.

In one aspect, the endless mat further comprises a knobby surface for massaging the body of the user while the endless belt is sliding.

In one aspect, the apparatus further comprises a plurality of serially connected units, wherein each of said units comprises the endless mat, the plurality of rollers, and the frame, wherein at least two of said units comprises a stand.

In one aspect, at least one transmission belt connects the rear driving roller of a first unit to the front driving roller of a second unit.

In one aspect, the frame of at least one of the units is vertically displaceable.

In one aspect, a first unit is foldable with respect to a second unit adjacent thereto.

The present invention is also directed to a method of exercising, comprising the steps of positioning a selected middle body area in direct contact with an endless mat looped around a plurality of horizontally spaced rollers each of which having a horizontally disposed and coplanar axis, including front and rear driving rollers, and at least three supporting rollers interposed between said front and rear driving rollers in such a way that adjacent supporting rollers are not in abutting relation with each other; propelling said selected middle body area along said endless mat, while continuing to be in direct contact therewith, between said front and rear driving rollers; causing, in a first stage of advancement of said selected middle body area, a portion of said endless mat to be depressed between first and second supporting rollers; causing, in a second stage of advancement of said selected middle body area, said depressed mat portion to rotate said first supporting roller and said endless mat to be manually driven; causing, in a third stage of advancement of said selected middle body area, said selected middle body area to be massaged by said second supporting roller in response to a magnitude and direction of forces applied to said second supporting roller while said selected middle body area performs a propelling movement; and repeating steps b-e with respect to a selected number of pairs of said at least three supporting rollers.

In one aspect, the propelling movement is a crawling movement involving alternating right side and left side movements. The propelling movement may be repeated forwardly and backwardly or backwardly and forwardly.

In one aspect, the selected middle body area is the back or the abdomen.

In one aspect, the selected middle body area is the gluteal region and the crawling movement is performed in a sitting position while involving alternating right side and left side movements of the gluteal region.

The method is used for promoting muscular release, skeletal motion recovery, rehabilitation and development of the nervous system, drainage of liquids from the lymphatic system, rehabilitation of the digestive system, respiratory system, and the urine canal, toning the upper stomach, or skin stretching.

In one aspect, the method further comprises the step of controlling a massaging force applied by the supporting rollers by replacing one or more endless mat layers with a layer of selected flexibility.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein:

FIG. 12C schematically illustrates in perspective view from the side of the formation of an endless mat from the strips of FIGS. 12A and 12B;

FIG. 12D is a plan view of the endless mat of FIG. 12C, showing two stitching formations.

DETAILED DESCRIPTION OF PREFERRED EMBODIMENTS

The present invention is an endless belt-like exercising sport mat device used for performing spinal based exercises that require a relatively very slow crawling movement of the body, forwards and/or backwards, in positions such as on the limbs, backside sitting, lying on the back, lying face down and the like as shown in FIGS. 9A-9E.

The slow movement in such activities is required in order to allow the user to perform non-linear or spiral natural movement of the joints and other body parts, such as the hands or legs. Preferably, the device is used to aid the user to rehabilitate or maintain different parts of the body, such as spine and joints.

Until now, in order to perform such crawling activities, it has been required to use a relatively long route (i.e., large room space for each user) and a plurality of exercise sport mats along that route. The device proposed by the present invention is aimed to replace the need for such a relatively large room space as well as the need to use a plurality of sport mats.

The device of the present invention is directed for both skeletal motion recovery and mid-section slimming and toning. It is unique since it is not dependent on the specific positioning of the four limbs, i.e., hands and legs, to enable application of the suggested method of use. Furthermore, the device of the present invention is not restricted to designated limb rests and/or specific sets of exercises and muscle groups. There has not been yet a skeletal motion recovery apparatus that is not dependent on limb movement to manipulate the spine and connecting skeletal structure.

Figure 1:
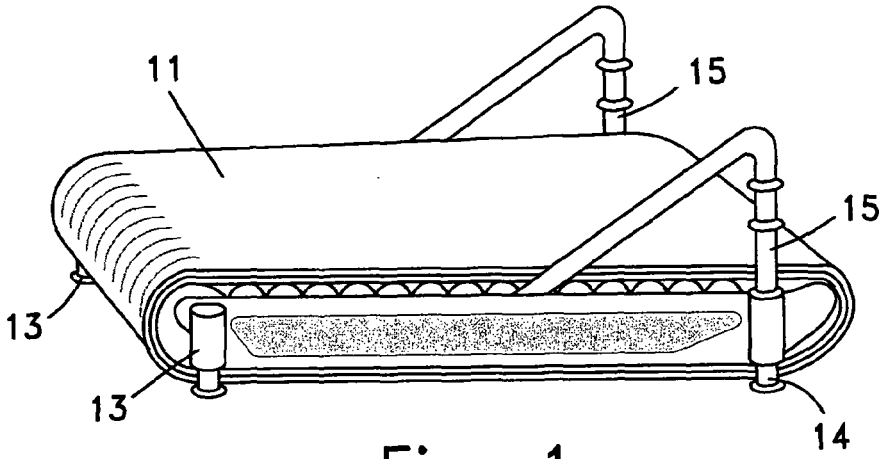
FIG. 1 schematically illustrates an exercising device for skeletal mobility recovery and slimming, according to one embodiment of the present invention.

Preferably, but not limitatively, the device of the present invention is directed to functional body recovery. This encompasses recuperative and remedial activities such as cardio-vascular or mechanical motion recuperation after major surgery, loss of mobility or of limbs/limb-mobility due to trauma. The device of the present invention is intended to accommodate specific sets of exercises for such activities. Such type of activities may achieve the following advantages:

- The position of the body in such activities eliminates damage to the spine and joints of the user;
- The crawling movements help to reduce the load on the spine and on the muscles of the user;
- Massaging different body areas, preferably, around the spine (e.g., for internal body parts and the nervous system);
- Rehabilitation and development of the nervous system;
- Drainage of liquids from the lymphatic system, after being released from various tissues;
- Healthy muscular development;
- Slimming and fat burning, especially at the abdominal area of the body;
- Rehabilitation of the digestive system, the respiratory system, the urinary canal, etc.;
- Skin stretching over the body;

Referring now to FIG. 1, the exercise device of the present invention shown therein is used to perform the aforementioned activities. The device comprises an endless belt 11, a rolling mechanism (an example for such mechanism is described with reference to FIG. 4) and rear and front stands made of suitably rigid material adapted to permit placement of the apparatus on a generally flat supporting surface such as a floor, such as rear stand 13 and front stand 14.

According to one embodiment of the invention, endless belt 11 is made of relatively soft and elastic materials, such as those used in common sport mats (e.g., latex or other suitable material from which common sport mats are made). Preferably, the endless belt 11 is also padded or covered with a foiled material for protecting the soft and elastic materials. Of course, the padding or covering can be replaced. According to one embodiment of the invention, the external surface of the endless belt is provided with a knobby surface for massaging the body of the user (not shown).

The apparatus of the present invention and accordingly the endless belt can have different dimensions. For example, the upper outer surface of the endless belt (i.e., the area used for performing the activities) can have the size of a standard sport mat, such as about 100 cm width and about 200 cm length. Of course, the length as well as the width of the activity surface of the endless belt can be smaller or even larger.

Figure 3:
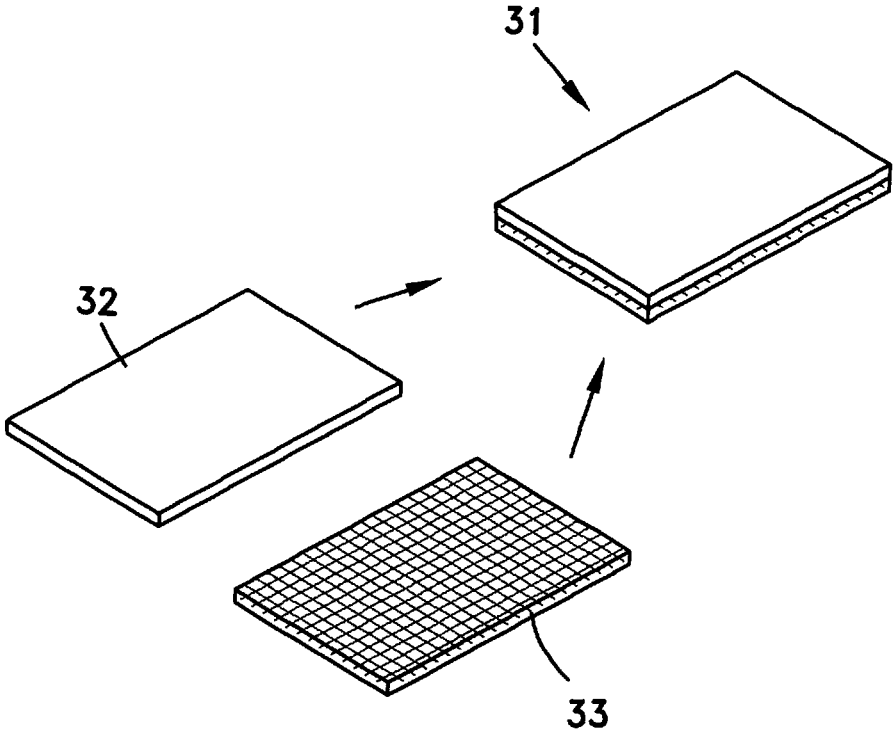
FIG. 3 schematically illustrates a portion of the endless belt of the device of FIG. 1, according to an embodiment of the present invention.

According to some embodiments of the invention, endless belt 11 comprises one or more layers. FIG. 3 schematically illustrates an endless belt 31 which is made of two different layers, an external layer 32 and an internal layer 33. External layer 32 is made of a soft and elastic material and is used as the working surface of the user. Internal layer 33 is made of rigid materials, such as Kevlar or any other abrasion resisting layer, and it is used to protect layer 32 from the internal elements of the device of the present invention as will be described hereinafter (see FIG. 4).

Figure 4:
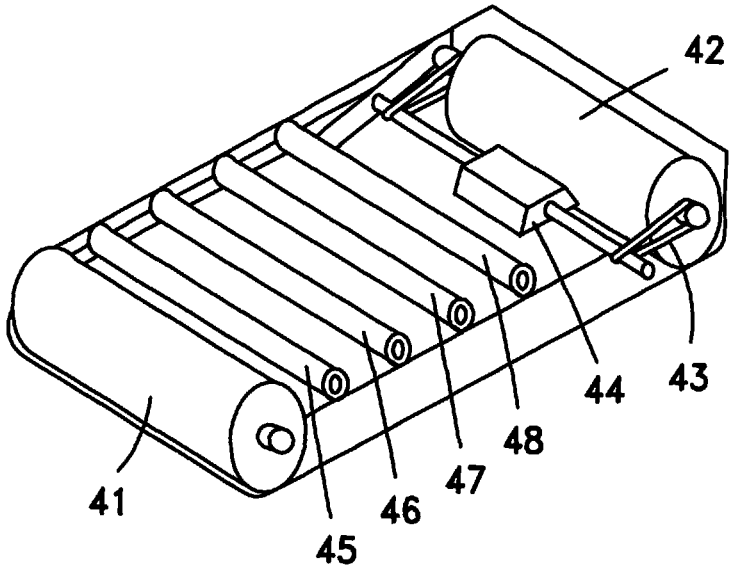
FIG. 4 schematically illustrates the internal elements of the device of FIG. 1, according to an embodiment of the present invention.

FIG. 4 schematically illustrates the internal elements of the device of the present invention. Some of the internal elements are used to support the user during the activities on the endless belt and others elements are used to drive the endless belt, either manually or automatically. The internal elements may comprise a supporting surface and a rolling mechanism.

The supporting surface is used for supporting the body of the user and for aiding the user to slide the endless belt while performing the activities on the endless belt. According to one embodiment of the invention, the supporting surface is a set of horizontally spaced rollers, such as rollers 45, 46, 47 and 48. The rolling of the rollers aids the user to slide the endless belt, as the apparatus of the present invention is directed to activities which require the user to move forward or backward while a large area of his body is in contact with the endless belt (e.g., while laying on the back or contrarily lying with his face down and the like).

The rolling mechanism is used for allowing the endless belt to be looped in a relatively low speed around such mechanism, thereby providing a lower belt section and an overlying upper belt section on which a user may perform the activities. According to an embodiment of the invention, the rolling mechanism comprises a rear driving roller 41 and a front driving roller 42.

Optionally, the device of the present invention further comprises an electric motor 44 and a corresponding transmission system, such as transmission belt 43 that is interconnected between one of the driving rollers, such as front driving roller 42, and the rotor of motor 44. The electric motor 44 is used for automatically rolling the front driving roller 42, thereby causing the endless belt to slide or move.

Preferably, the supporting rollers 45-48 are used for supporting the body of the user while doing crawling activities on the endless belt and for aiding the user to perform the crawling movement. In most exercises, almost the entire body of the user is in a lying position on the endless belt, or at least a relatively large surface or portion of the body is in direct contact with the endless belt. Preferably, but not limitatively, the internal elements are located within a rigid frame which has corresponding roller-receiving cavities for the set of supporting rollers 45-48.

The endless belt of the device of the present invention covers the internal elements and whenever the user forces a movement of the endless belt with his body during performance of a crawling movement, the rollers are caused to be rotated. According to another embodiment of the present invention, whenever the optional motor is active, it rotates the rollers 45-48, causing the endless belt 11 to move.

As aforementioned, the endless belt may have a padded layer (e.g., layer 32) and a relatively rigid layer, such as layer 33, as shown in FIG. 3. The rigid layer 32 is engaged directly to the driving rollers 41, 42 to permit the movement of the endless belt. The top surface of the endless belt is provided with suitable padding, such as layer 32 for protecting the extremities of the limbs and other parts of the user body, as well as to avoid any damage to them.

As aforementioned, the device of the present invention has two basic modes of operation: a manual motion mode during which the person who is training creates the motion in the tread belt, and a motorized motion mode wherein a motor is used to create the motion in the endless tread belt. This is achieved by connecting an electrical motor to one or more of the endmost rollers, of the roller series. The said roller series provides mechanical support to the endless tread belt topside (i.e., the exercise area) as well as optionally delivering motion from an electrical motor to rotate the tread belt in a continuous operator controlled regime.

Figure 2:
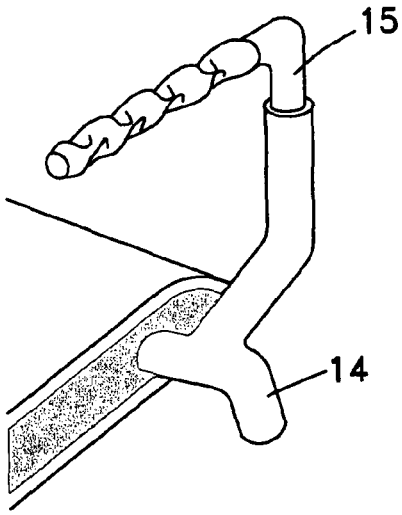
FIG. 2 schematically illustrates the handle for the device of the device of FIG. 1, according to an embodiment of the present invention.

Referring now to FIG. 2, the device of the present invention may further comprise one or more handles capable of being attached to each one of the stands. Preferably, but not limitatively, the device of the present invention comprises two handles 15 connected to the front stands 14. Of course, the handles 15 can be detached from the front stands, and can be attached to the rear stands 13.

According to an embodiment of the present invention, the exercise device further comprises a control unit, for controlling the movement of the endless belt, either forward or backward, and for controlling the relatively low speeds of its movements. Optionally, the control unit is further provided with a remote control unit, for remotely controlling the device or while the user is on the exercise device in such a position that he cannot operate the control unit.

Figure 11:
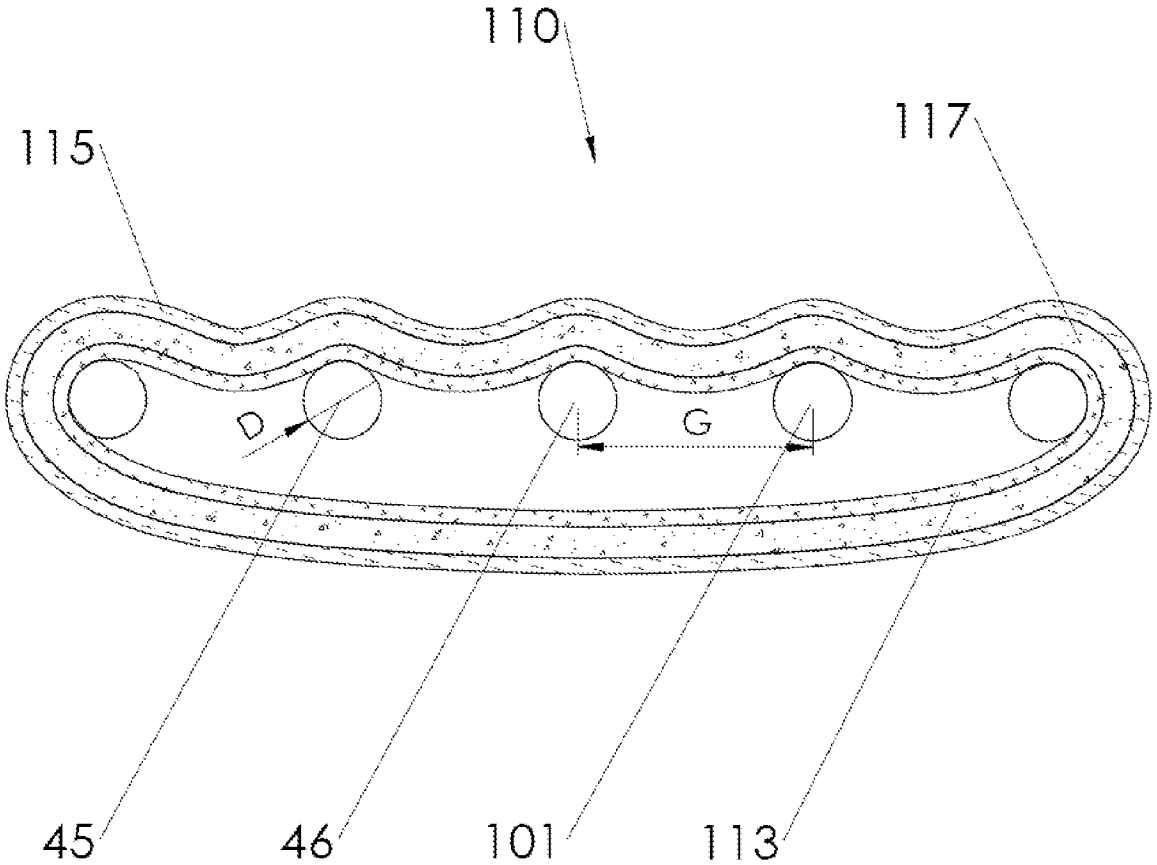
FIG. 11 is a cross sectional view of a portion of an exercise apparatus, according to an embodiment of the invention.
Figure 12A:
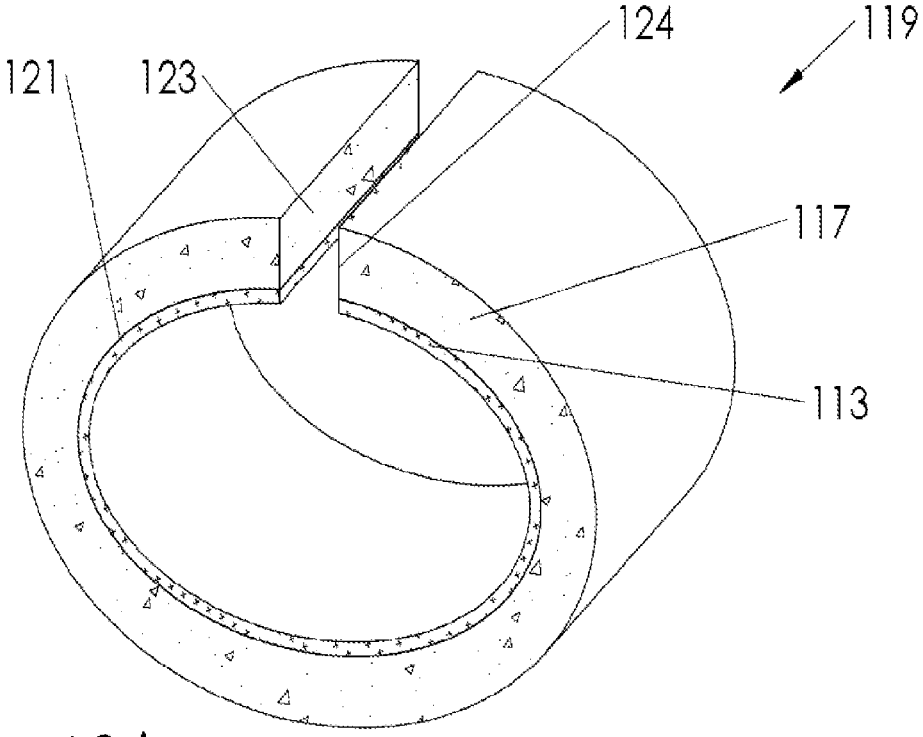
FIG. 12A schematically illustrates in perspective view from the side of the formation of an endless strip made of an abrasion resisting layer and a compressible layer.
Figure 12B:
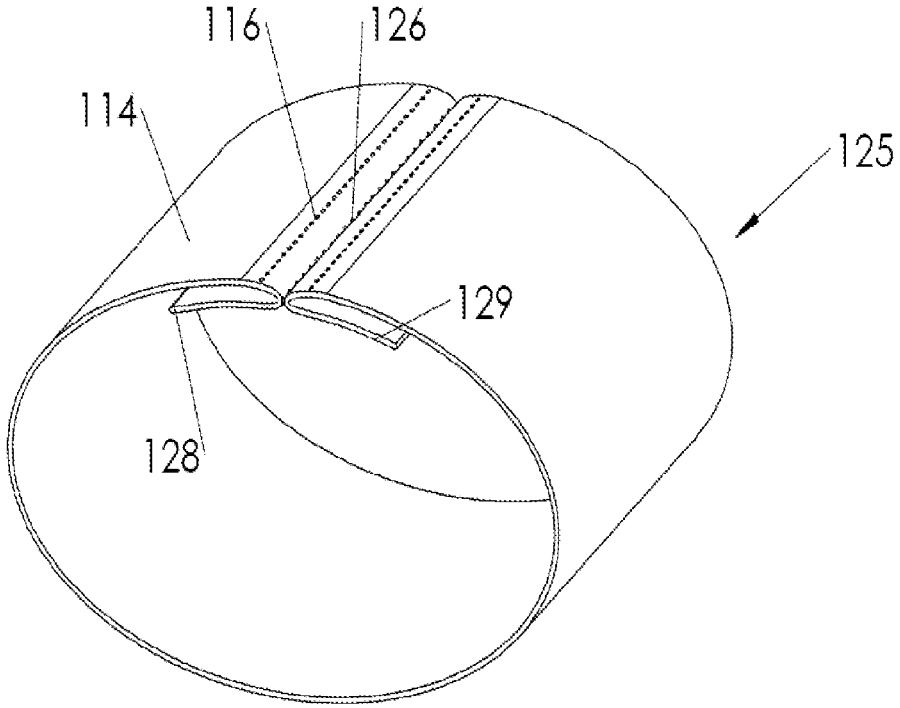
FIG. 12B schematically illustrates in perspective view from the side of the formation of an endless protective layer strip.
Figure 13:
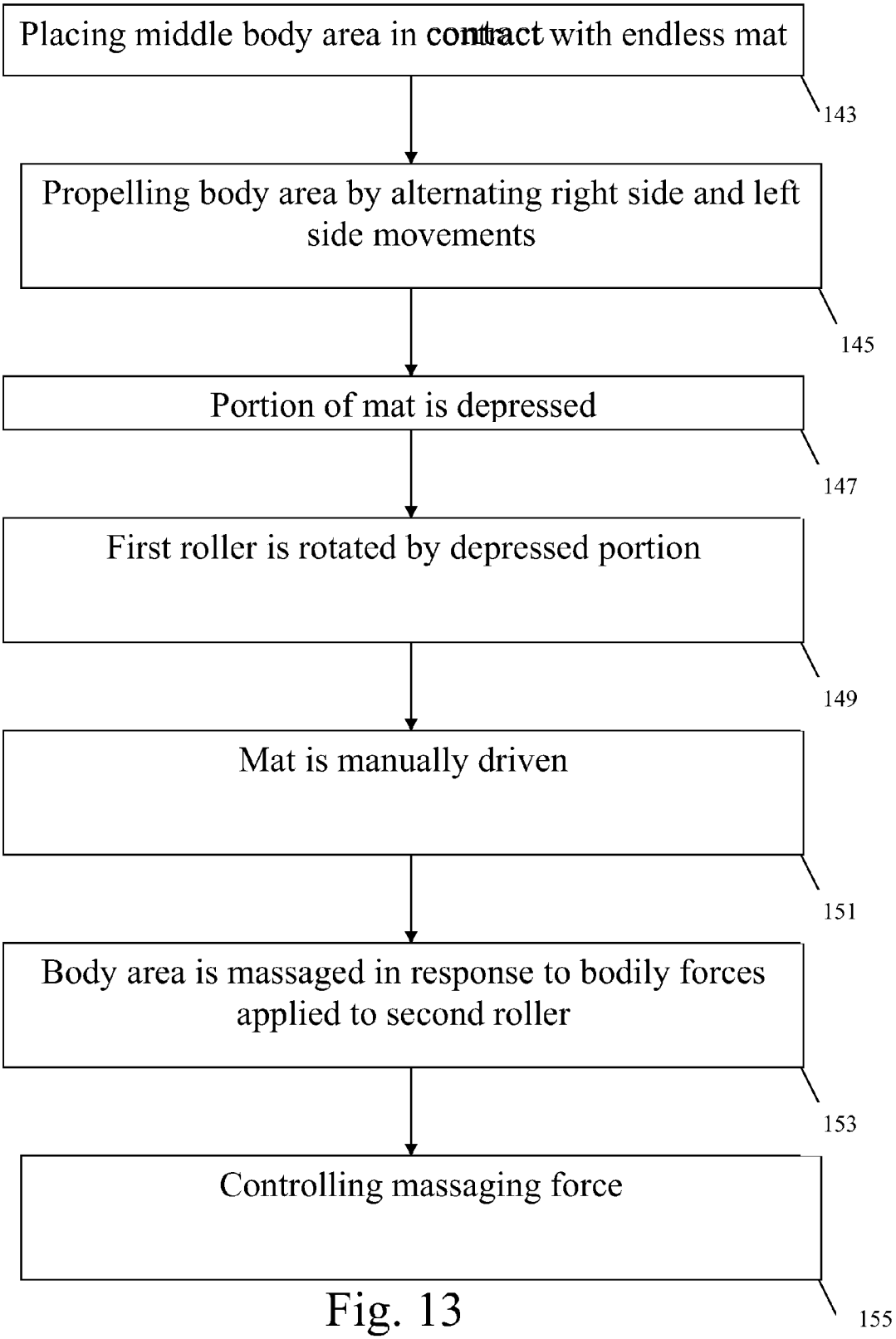
FIG. 13 is a method of exercising, according to one embodiment of the present invention.

A preferred embodiment of the present invention is illustrated in FIGS. 11-13. wherein a motorless, manually driven exercise apparatus 110 is adapted to induce massaging of a selected body area during performance of crawling movements.

A partial cross sectional view of exercise apparatus 110 is shown in FIG. 11. Exercise apparatus 110 comprises a plurality of horizontally spaced supporting rollers 45-47 interposed between rear driving roller 41 and front driving roller 42, which are illustrated in FIG. 4. The axis of each of the driving and supporting rollers, e.g. axis 101, is horizontally disposed and mutually coplanar. The spacing G between each adjacent supporting roller or between a driving roller and supporting roller ranges from 2 to 4 times the diameter D of a supporting roller, and is sufficiently great to ensure that an endless mat 115 looped around the rollers will be depressed under the weight of a user during crawling movements thereon, as will be described hereinafter.

Endless mat 115 comprises a compressible layer 117 made of a soft and elastic material, and an inner layer 113 made of a woven abrasion resisting material, which is contiguous with compressible layer 117 and adapted to contact the supporting and driving rollers. Compressible layer 117 may have a thickness ranging from 5-30 mm and may be compressed up to one-fifth of its original thickness in response to a crawling movement. Compressible layer 117 may be covered with a protective layer 118 such as a sweat resistant material, e.g. leather. The self weight of the holds the endless mat 115 over the rollers, but in any case, the endless mat 115 is in a relaxed condition without any tension. This way, the endless mat 115 is able to move over the rollers solely by the force applied by the user.

FIGS. 12A-D illustrate the method by which endless mat 115 is produced.

Firstly, as shown in FIG. 12A, strips having an equal length and width of abrasion resisting layer 113 and compressible layer 117 are adhesively connected together, throughout the entire surface area at interface 121 between the two layers. The two longitudinal ends 123 and 124 of the combined strip are then adhesively connected together, to form an endless combined strip 119 over which the user is able to crawl when looped about the rollers.

Two ends of a strip of protective layer 118 having the same width as, and a slightly longer length than, the endless combined strip 119 are stitched together at connection 126, to form an endless protective layer strip 125, as shown in FIG. 12B. The two terminal longitudinal portions 128 and 129 of the strip are folded inwardly to the main portion 114 of the strip, and each of the two folds is stitched to main portion 114 at a corresponding connection 116.

In FIG. 12C, the endless protective layer strip is positioned outwardly from, and in abutting relation with, the endless combined strip, and then the three layers 113, 117 and 118 are stitched together to form endless mat 115. Stitching 127 is introduced throughout the thickness of endless mat 115.

In the plan view of endless mat 115 shown in FIG. 12D, the stitching that is introduced throughout the thickness of endless mat 115 is continued longitudinally throughout its circumference. Two stitching formations 132 and 133 are consequently produced proximate the two lateral ends 136 and 137, respectively, of mat 115, while providing a central unstitched region 139 between formations 132 and 133, along which a user performs the crawling motions. Each of stitching formations 132 and 133 may be formed by a plurality of longitudinal stitching lines 127*a-c*, e.g. three, or by any other desired number.

Stitching formations 132 and 133 are adapted to prevent relative lateral motion between adjacent layers of endless mat 115 despite alternating right side and left side crawling movements initiated by the user which apply shear forces thereto. The stitching introduced through the three layers absorbs the applied shear forces, and is further reinforced by additional stitching that is applied in its proximity. The longitudinally extending stitching formations also prevent separation of the adjacent layers despite the longitudinal advancement of the user during performance of the crawling movements, whether forwardly or backwardly.

Referring now to FIG. 13, a user performs a crawling motion by first placing in step 143 a selected middle body area, e.g. the abdominal area, the gluteal region, and the back, in contact with the central unstitched region of the endless mat, and then propelling the middle body area in step 145 by alternating right side and left side movements, resulting in longitudinal advancement along the endless mat. The body weight is distributed over the relatively wide area of the middle body area that contacts the endless mat, and is supported therebelow by a plurality of supporting rollers. During each alternating movement, a corresponding side region of middle body area is raised while the other side region is lowered onto the endless mat, lowering the required propelling force effecting the longitudinal advancement which is applied to each supporting roller.

A crawling motion induces massaging of the selected body area during three stages of longitudinal advancement. (1) In step 147, a portion of the endless mat is caused to be depressed between a first supporting roller and a second supporting roller in response to the crawling movement. (2) In step 149, the movement of the depressed portion rotates the first supporting roller, causing the endless mat to be manually driven in step 151. (3) In step 153, the selected body area is massaged by the second supporting roller in response to the magnitude and direction of forces applied to the second supporting roller while the selected body area performs a propelling movement.

By placing a selected body area that needs to be treated on the endless mat, the user can cause a limited selected body area to be massaged by periodic contact with a supporting roller. During the longitudinal advancement, which may be first forwards and then rearwards, the roller derived force is not sensed when the selected body area passes between two adjacent supporting rollers and is then sensed when the selected body area contacts a roller. The massaging effect is characterized by a gentle rolling sensation that enables a significant movement of blood and lymph through the selected body area for purposes of detoxification.

The massaging force applied by the supporting rollers may be controlled by replacing one or more of the endless mat layers in step 155 with a layer of selected flexibility.

Figure 7A:
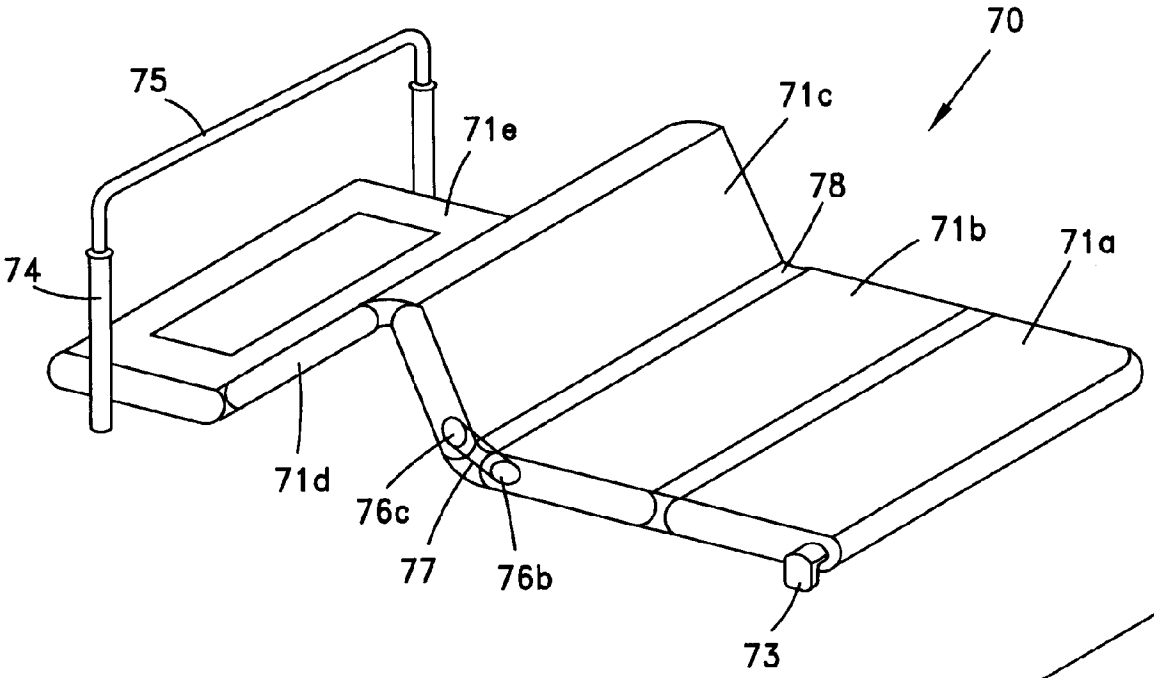
FIG. 7*a* schematically illustrates an exercising device for skeletal mobility recovery and slimming provided with foldable means, according to another embodiment of the present invention.
Figure 7B:
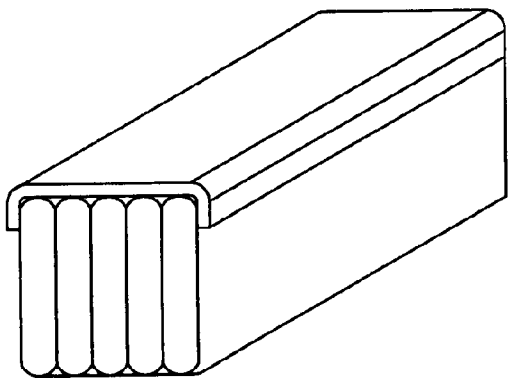
FIG. 7*b* schematically illustrates the device of FIG. 7*a* in a folded position.
Figure 8A:
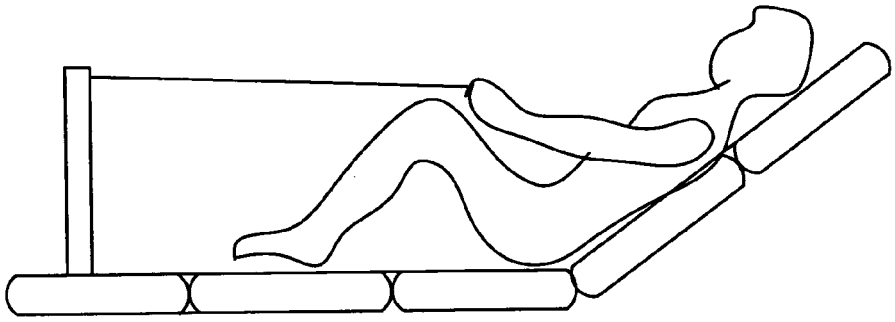
FIGS. 8*a* and 8*b* schematically illustrate examples of exercises activities using the device of FIG. 7*a;*
Figure 8B:
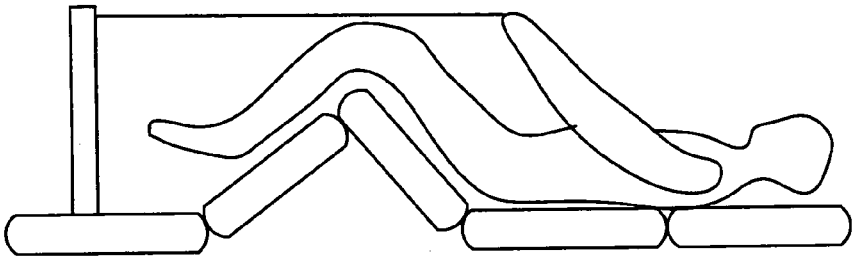
Figure 9A:
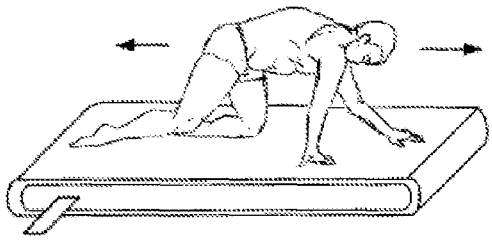
FIGS. 9A-E schematically illustrates examples of exercises activities using the device of FIG. 1.
Figure 9B:
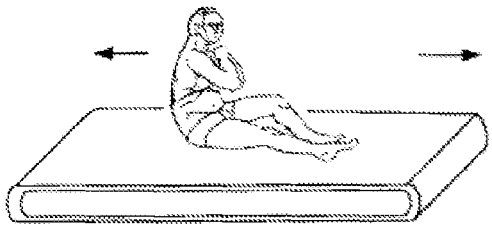
Figure 9C:
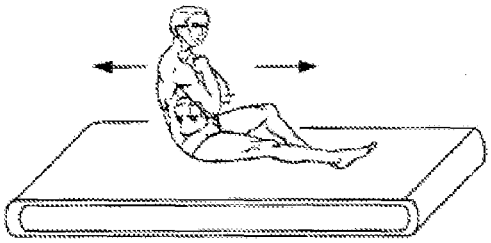
Figure 9D:
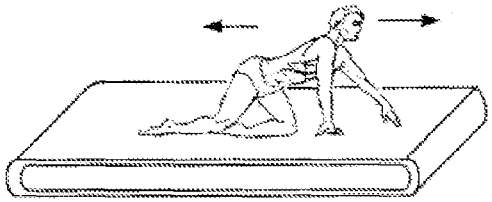
Figure 9E:
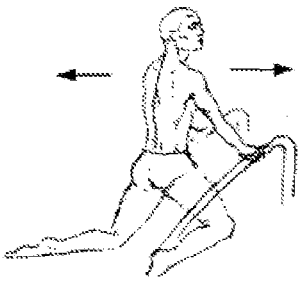

Referring now to FIGS. 7A and 7B, according to some embodiments of the invention, the apparatus may further comprise transmission systems for connecting in a serial manner between two adjacent similar units of the exercising apparatus of the invention (FIG. 7A), thus allowing the adjacent units to fold (FIG. 7B). FIGS. 8A and 8B schematically illustrate examples for the folding angles of the apparatus according to the embodiment described with reference to FIG. 7A.

FIG. 7A schematically illustrates an exercising device 70 for skeletal mobility recovery and slimming provided with foldable element or means, according to another embodiment of the present invention. Device 70 comprises two or more individual movable or rotatable units, such as units 71*a*-71*e*, rear and front stands made of suitably rigid material adapted to permit placement of the apparatus on a generally flat supporting surface such as a floor, such as rear stand 73 and front stand 74.

Each of the individual movable units, such as units 71*a*-71*e*, comprises the following main elements: an endless belt, a supporting surface and rolling mechanism. The elements of each unit are connected and operated in similar manner to the structure of the device of the present invention, as described hereinabove. Preferably, but not limitatively, each of the units 71*a*-71*e* can be operated individually.

Actually, each of the movable units 71*a*-71*e* is a resized structure of the device of the present invention, but in a shorter or smaller size For example, the dimensions of the upper outer surface of the endless belt (i.e., the area used for performing the activities) are about 100 cm in width and about 40 cm in length. Of course, the length as well as the width of the activity surface of the endless belt can be smaller or even larger.

Units 71*a*-71*e* are connected via a transmission system, which comprises rollers and a suitable transmission mechanism, such as rollers 76*b* of unit 71*b*, roller 76*c* of unit 71 and transmission belt 77 which physically connects units 71*b* and 71*c*. A similar transmission system can be located at the opposite side of units 71*b* and 71*c* (e.g., transmission belt 78). The transmission systems which connect each two adjacent units allow all the units 71*a*-71*e* to work simultaneously (i.e., as a uniform surface).

Each one of the two or more individual endless belts of each unit is made of a relatively soft and elastic material, or is padded or covered with foil material, such as latex.

Figure 10C:
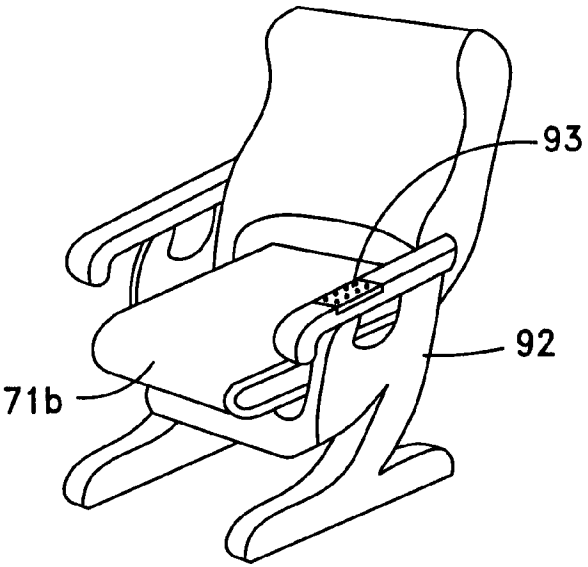
FIGS. 10A-10C schematically illustrate examples for implementing a single smaller version unit of the apparatus of the present invention.
Figure 10B:
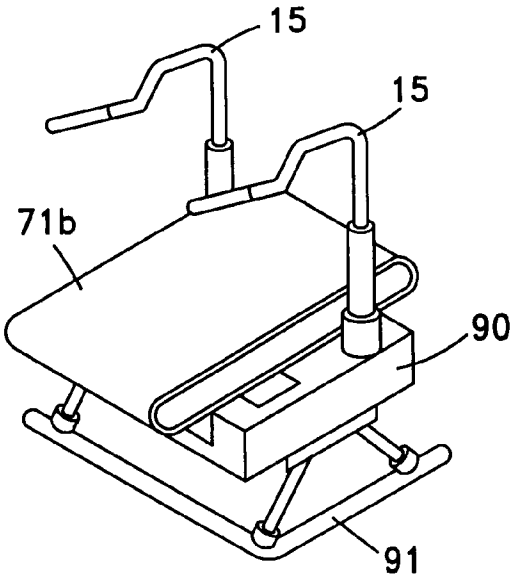
Figure 10A:
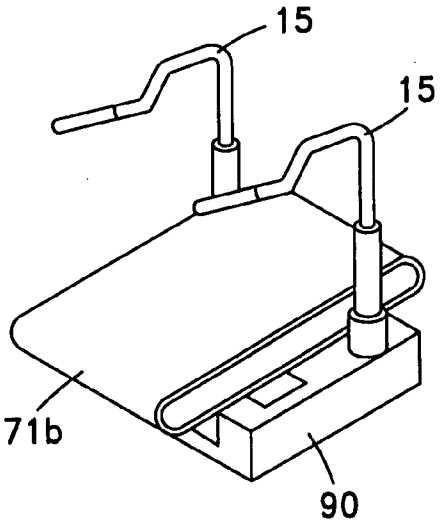

According to another embodiment of the invention, a single unit of the apparatus, i.e., a smaller version of the apparatus of the present invention can be used as seat, thereby allowing performing exercises while sitting on such a single unit. FIGS. 10A-10C schematically illustrate three examples, respectively, for implementing a single smaller version unit 71*b* of the apparatus of the present invention. In FIG. 10A, unit 71*b* is provided with two handles 15 and is placed on a suitable base 90. In FIG. 10B, base 90 is provided with a stand 91, preferably, but not limitatively, having an adjustable height, thus allowing the adjustment of the height of unit 71*b*. In FIG. 10C, unit 71*b* is embedded within a suitable chair formed from base 92. Optionally, a controller 93 for controlling the operation of unit 71*b* is also shown.

Figure 5:
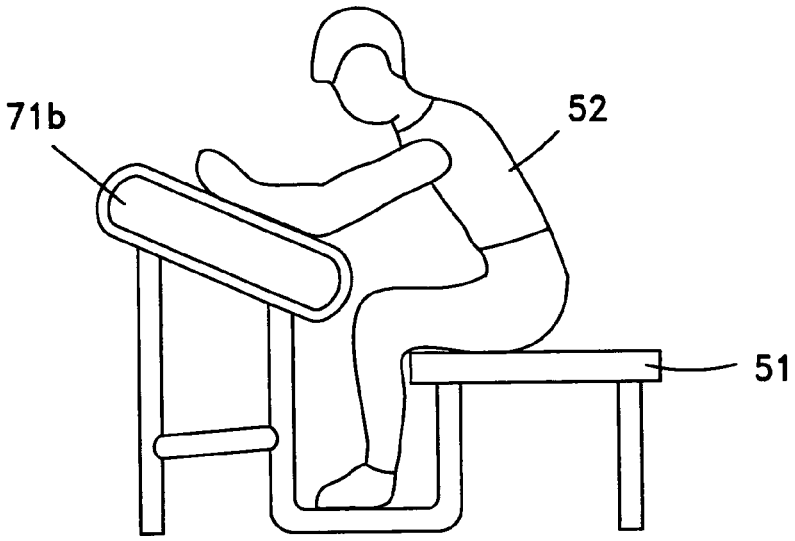
FIG. 5 schematically illustrates an example for implementing the exercising device, according to one embodiment of the present invention.

The exercising device of the present invention can be implemented in a plurality of ways and can be integrated or implemented with different structures, thereby allowing a user to perform different activities with different parts of the body. FIG. 5 schematically illustrates an example for implementing an exercising device 71*b* as a table like form, according to an embodiment of the invention. In such an implementation, a user 52 can perform different exercises by placing his forearms (e.g., the part of the arm which extends between the elbow and the wrist) on the upper surface of the exercising device 71*b*. The table-like form may further comprise an integrated bench or chair, such as bench 51. User 52 may perform the exercises while sitting on bench 51.

Figure 6B:
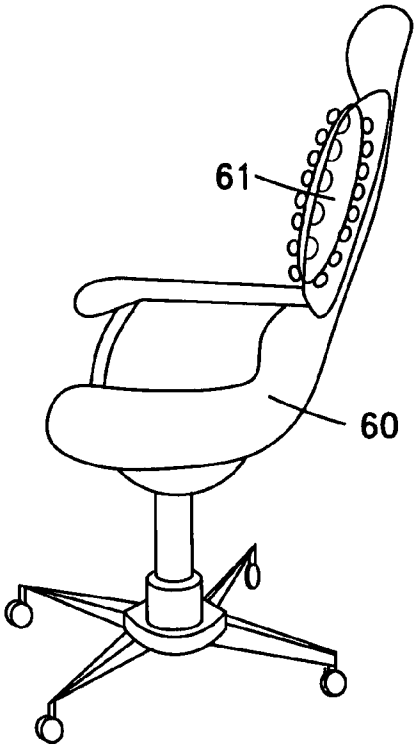
FIGS. 6A-B schematically illustrate another example for implementing the exercising device, according to another embodiment of the present invention.
Figure 6A:
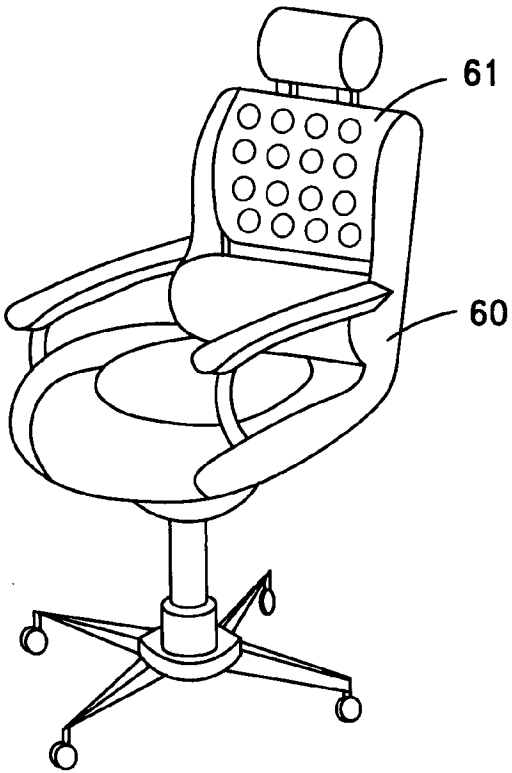

The exercising device of the present invention can be also implemented as the back part of a chair. FIGS. 6A and 6B schematically illustrate an example for such an implementation, by which an exercising device 61 of the present invention is used as the back part of a chair 60. Such an implementation allows a user to perform different exercise or activity while sitting on chair 60.

Although embodiments of the invention have been described by way of illustration, it will be understood that the invention may be carried out with many variations, modifications, and adaptations, without exceeding the scope of the claims.

The invention claimed is:

1. A manually driven exercising apparatus for allowing mobility recovery and slimming activities during crawling movements of the body, comprising:

a) an endless sport mat on top of which said activities are performable, said mat comprising an outer layer made of a soft and elastic material, and an inner layer contiguous with said outer layer and made of a flexible abrasion resisting material;

b) a plurality of horizontally spaced rollers about which said inner layer of said endless mat is looped, including front and rear driving rollers, and at least three supporting rollers for supporting a selected middle body area of a user in direct contact with said endless mat during performance of crawling movements, said at least three supporting rollers being interposed between said front and rear driving rollers in such a way that adjacent supporting rollers are not in abutting relation with each other, the axis of each of said at least three supporting rollers being essentially horizontally disposed and coplanar; and c) a rigid frame, for housing, and to which are rotatably mounted, said plurality of rollers, wherein said mat outer and inner layers have a sufficient combined degree of flexibility in the vertical direction so that one or more of said at least three supporting rollers is felt by said selected middle body area of the user during performance of said crawling movements, wherein each of said supporting rollers is sufficiently spaced from an adjacent supporting roller such that said endless mat is depressible under the weight of the user during said crawling movements thereon between said front and rear driving rollers, causing said plurality of supporting rollers to be rotated and said endless mat to be manually driven, whereby said exercising apparatus massages said selected body area of the user by means of said plurality of supporting rollers in response to a magnitude and direction of forces applied to said plurality of supporting rollers during performance of said crawling movements.

2. The apparatus according to claim 1, wherein the axis of each of the supporting rollers is spaced from the axis of an adjacent supporting roller or of a driving roller by a distance ranging from 2 to 4 times the diameter of a supporting roller.

3. The apparatus according to claim 1, wherein the outer layer is compressible up to one-fifth of its original thickness in response to a crawling movement.

4. The apparatus according to claim 3, wherein the original thickness of the outer layer ranges from 5 to 30 mm.

5. The apparatus according to claim 1, wherein the endless mat is covered with a protective layer.

6. The apparatus according to claim 5, wherein two ends of the protective layer are connected together to form an endless protective strip, said endless protective strip being positioned outwardly from, and stitched to, an endless combined strip made of the inner and outer layers which are adhesively connected to each other.

7. The apparatus according to claim 5, wherein the endless protective strip and the endless combined strip are stitched together by two longitudinally extending stitching formations located proximate to two lateral ends, respectively, of the endless mat, defining therebetween a central unstitched region along which the crawling motions are performable, in said two formation the stitching being introduced throughout the thickness of the endless mat to prevent relative lateral motion between adjacent layers of the endless mat.

8. The apparatus according to claim 1, further comprising one or more stands connected to said frame for stabilizing said apparatus on top of a suitable surface.

9. The apparatus according to claim 8, further comprising one or more handles attached to the one or more stands for aiding the user to perform some of the activities on the endless mat.

10. The apparatus according to claim 1, further comprising a plurality of serially connected units, wherein each of said units comprises the endless mat, the plurality of rollers, and the frame, wherein at least two of said units comprises a stand.

11. The apparatus according to claim 10, wherein at least one transmission belt connects the rear driving roller of a first unit to the front driving roller of a second unit.

12. The apparatus according to claim 1, wherein the frame is vertically displaceable.

13. The apparatus according to claim 10, wherein a first unit is foldable with respect to a second unit adjacent thereto.

14. The apparatus according to claim 5, wherein material of the protective layer is selected from the group consisting of latex, a foil, and sweat resistant material.

15. A method of exercising, comprising the steps of:

a) providing an endless mat looped around a plurality of horizontally spaced rollers;

b) positioning a selected middle body area in direct contact with the endless mat looped around the plurality of horizontally spaced rollers each of which having a horizontally disposed and coplanar axis, including front and rear driving rollers, and at least three supporting rollers interposed between said front and rear driving rollers in such a way that adjacent supporting rollers are not in abutting relation with each other;

c) propelling said selected middle body area along said endless mat, while continuing to be in direct contact therewith, between said front and rear driving rollers;

d) causing, in a first stage of advancement of said selected middle body area, a portion of said endless mat to be depressed between first and second supporting rollers;

e) causing, in a second stage of advancement of said selected middle body area, said depressed mat portion to rotate said first supporting roller and said endless mat to be manually driven;

f) causing, in a third stage of advancement of said selected middle body area, said selected middle body area to be massaged by said second supporting roller in response to a magnitude and direction of forces applied to said second supporting roller while said selected middle body area performs a propelling movement; and g) repeating steps c-f with respect to a selected number of pairs of said at least three supporting rollers.

16. The method according to claim 15, wherein the propelling movement is a crawling movement involving alternating right side and left side movements that are repeated forwardly and backwardly or backwardly and forwardly.

17. The method according to claim 15, wherein the selected middle body area is the back or the abdomen.

18. The method according to claim 16, wherein the selected middle body area is the gluteal region and the crawling movement is performed in a sitting position while involving alternating right side and left side movements of the gluteal region.

19. The method according to claim 15, for promoting muscular release, skeletal motion recovery, rehabilitation and development of the nervous system, drainage of liquids from the lymphatic system, rehabilitation of the digestive system, respiratory system, and the urine canal, toning the upper stomach, or skin stretching.

20. The method according to claim 15, further comprising the step of controlling a massaging force applied by the supporting rollers by replacing one or more endless mat layers with a layer of selected flexibility.

* * * * *